US007220525B2

(12) United States Patent
Riley et al.

(10) Patent No.: US 7,220,525 B2
(45) Date of Patent: May 22, 2007

(54) SECURE IMAGING TONER AND METHODS OF FORMING AND USING THE SAME

(75) Inventors: Michael R. Riley, Steubenville, OH (US); Kevin L. Heilman, Wheeling, WV (US)

(73) Assignee: Troy Group, Inc., Santa Ana, CA (US)

( * ) Notice: Subject to any disclaimer, the term of this patent is extended or adjusted under 35 U.S.C. 154(b) by 0 days.

(21) Appl. No.: 11/206,498

(22) Filed: Aug. 18, 2005

(65) Prior Publication Data

US 2005/0282077 A1 Dec. 22, 2005

Related U.S. Application Data

(63) Continuation-in-part of application No. 10/437,816, filed on May 14, 2003, now Pat. No. 6,991,883.

(60) Provisional application No. 60/381,405, filed on May 16, 2002.

(51) Int. Cl.
*G03G 9/00* (2006.01)

(52) U.S. Cl. ..... 430/108.21; 430/108.1; 430/108.11; 430/108.23; 430/124; 430/137.1; 430/137.18; 430/10

(58) Field of Classification Search ..... 430/108.21, 430/108.1, 108.11, 108.23, 124, 137.1, 137.18, 430/10

See application file for complete search history.

(56) References Cited

U.S. PATENT DOCUMENTS 4,496,961 A 1/1985 Devrient ..... 346/206
4,936,607 A 6/1990 Brunea et al. ..... 283/70
4,942,410 A 7/1990 Fitch et al. ..... 346/160.1
4,958,173 A 9/1990 Fitch et al. ..... 346/160.1
5,033,773 A 7/1991 Brunea et al. ..... 283/95
5,123,999 A 6/1992 Honnorat et al. ..... 162/140
5,124,217 A 6/1992 Gruber et al. ..... 430/39
5,366,833 A 11/1994 Shaw et al. ..... 430/10
5,523,167 A 6/1996 Hunt et al. ..... 428/484
5,666,598 A 9/1997 Sugita et al. ..... 399/136
5,698,616 A 12/1997 Baker et al. ..... 523/201
5,714,291 A 2/1998 Marinello et al. ..... 430/106
6,991,883 B2 * 1/2006 Riley et al. ..... 430/108.21
6,998,211 B2 * 2/2006 Riley et al. ..... 430/108.21

* cited by examiner

*Primary Examiner*—Mark A. Chapman

(57) ABSTRACT

A toner for printing documents that are difficult to chemically or physically forge and that are readily easy to visually verify and methods of using and forming the toner are disclosed. The toner includes a colorant for printing an image on a surface of a document and a dye for forming a latent version of the image underneath a surface of a substrate. An image formed using the toner of the invention is readily verified by comparing the colorant-formed image and the dye-formed image. In addition, if a solvent is used in an attempt to alter the printed image on the substrate, the dye migrates or diffuses to indicate tampering with the document.

27 Claims, 3 Drawing Sheets

SECURE IMAGING TONER AND METHODS OF FORMING AND USING THE SAME

CROSS REFERENCE TO RELATED APPLICATIONS

This application is a continuation-in-part of U.S. application Ser. No. 10/437,816, entitled TONER FOR PRODUCING SECURE IMAGES AND METHODS OF FORMING AND USING THE SAME, filed May 14, 2003, now U.S. Pat. No. 6,991,883 which claims the benefit of U.S. Provisional Patent Application Ser. No. 60/381,405, entitled METHOD AND APPARATUS FOR SECURE PRINTING OF TONER-BASED IMAGES, filed May 16, 2002.

FIELD OF INVENTION

The present invention relates to apparatus and methods for printing and copying documents. More particularly, the invention relates to an improved toner for printing or copying documents in a secure manner, such that the documents are difficult to forge, sensitive to chemical attacks, and original versions of the documents are readily verifiable, and to methods of using and making the toner.

BACKGROUND OF THE INVENTION

Toner-based document imaging, such as electrophotographic, iongraphic, magnetographic, and similar imaging techniques, generally involves forming an electrostatic or magnetic image on a charged or magnetized photoconductive plate or drum, brushing the plate or drum with charged or magnetized toner, transferring the image onto a substrate such as paper, and fusing the toner onto the substrate using heat, pressure, and/or a solvent. Using this technique, relatively inexpensive images can be easily formed on a surface of the substrate.

Because toner-based imaging is a relatively quick and inexpensive technique for producing copies of images, the technique is often employed to produce documents that were traditionally formed using other forms of printing or imaging—e.g., impact printing or ink-jet printing. For example, in recent years, toner-based imaging has been employed to produce financial documents, such as personal checks, stocks, and bank notes; legal documents such as wills and deeds; medical documents such as drug prescriptions and doctors' orders; and the like. Unfortunately, because the image is formed on the surface of the substrate, documents produced using toner-based imaging techniques are relatively easy to forge and/or duplicate.

Various techniques for printing or forming secure documents have been developed over the years. For example, U.S. Pat. No. 5,124,217, issued to Gruber et al. on Jun. 23, 1992, discloses a secure printing toner for electrophotographic processing. This toner, when exposed to a solvent such as toluene, often used in document forgery, produces a color stain indicative of the attempted forgery. This toner is only useful to disclose an attempted forgery when a particular solvent is used to remove a portion of a printed image. Thus, the toner cannot be used to mitigate copying of the document or forgery by adding material to the document.

U.S. Pat. No. 5,714,291, issued to Marinello et al. on Feb. 3, 1998, discloses another toner that includes submicron ultraviolet sensitive particles. An authenticity of the document can be verified using an ultra-violet scanner. Requiring use of an ultra-violet scanner is generally undesirable because it adds cost to a forgery analysis and requires additional equipment.

Other techniques for producing secure images include modifying the paper onto which the image is printed. Such modified papers include paper including a low-ink-absorption coating and paper including crushable micro capsules that contain leuco ink and a color acceptor. Although techniques including these forms of paper work relatively well for impact-type printing or copying, the techniques would not work well in connection with toner-based printing methods.

Other techniques for producing secure images include providing special paper coatings to increase smudge resistance of an image created by an electrostatic process. However, the coatings generally do not affect an ability to add material to the document or authenticate the originality of the document.

For the foregoing reasons, improved methods and apparatus for forming secure documents using toner-based processing, which are relatively easy and inexpensive, are desired.

SUMMARY OF THE INVENTION

The present invention provides an improved toner for producing secure images and improved methods of forming and using the toner. Besides addressing the various drawbacks of the now-known toners and methods, in general, the invention provides a toner that produces images that are difficult to alter and that are easy to visually assess whether the images have been chemically or mechanically altered.

In accordance with various embodiments of the invention, the toner includes a colorant and a dye. The dye migrates and/or dissolves when exposed to polar and/or non-polar solvents used to tamper with, e.g., remove the colorant from, printed documents. Thus, the dye adds an additional security feature of indicating when an attempted forgery has occurred.

In accordance with one embodiment of the invention, the toner includes a colorant that forms a printed image on a first surface of a substrate and a dye that migrates through the substrate to form a latent version of the image that is visible on a second surface of the substrate. In accordance with one aspect of this embodiment, the toner includes a thermoplastic resin binder, a charge-controlling agent, a release agent, as well as the colorant and the dye. In accordance with a further aspect of this embodiment, the toner includes a migration-enhancing agent. Exemplary migration-enhancing agents include oils, plasticizers, and other polymeric materials. In general, the migration-enhancing agent facilitates migration of the dye from the first surface of the substrate to the second surface of the substrate and acts as solvent for the dye. The toner in combination with a substrate, such as paper, can be used to produce a secure image that is difficult to forge and that is easy to determine whether the image is an original copy of the document by comparing the printed image formed on the first surface of the substrate with the dye-formed copy of the image visible from the second surface of the substrate.

In accordance with another embodiment of the invention, a toner includes a colorant that forms a printed image on a first surface of a substrate and a dye that migrates through a portion of the substrate and forms a copy of the image that is visible from the first surface of the substrate. The printed image can be compared to the copy formed with the dye to determine if the original printed image has been altered.

In accordance with a further embodiment of the invention, the toner includes a colorless, dye-forming agent and/or a co-reactant that reacts with the dye-forming agent to produce a latent image of a printed image.

In accordance with yet another embodiment of the invention, a method of forming a toner includes melt-blending binder resin particles, mixing colorant particles, charge-control agents, release agents, the dye, and migration agents with the resin particles, cooling the mixture, classifying the mixture, and dry blending the classified mixture with inorganic materials. In accordance with alternative embodiments of the invention, the toner is formed using melt dispersion, dispersion polymerization, suspension polymerization, or spray drying.

In accordance with another embodiment of the invention, an image is formed on a substrate by electrostatically transferring an image to a first surface of the substrate and forming a copy of the image that is visible from a second surface of the substrate by applying a toner, including a migrating dye, to the substrate. In accordance with one aspect of this embodiment, the method of forming an image includes providing a toner that includes a migration-enhancing agent.

BRIEF DESCRIPTION OF THE DRAWING FIGURES

A more complete understanding of the present invention may be derived by referring to the detailed description and claims, considered in connection with the figures, wherein like reference numbers refer to similar elements throughout the figures, and:

FIG. 1 illustrates a system, including a toner in accordance with the present invention, for printing secure documents;

FIG. 2(*a*) and FIG. 2(*b*) illustrate a check formed using the toner of the present invention;

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

The following description is provided to enable a person skilled in the art to make and use the invention and sets forth the best mode contemplated by the inventors of carrying out their invention. Various modifications to the description, however, will remain readily apparent to those skilled in the art, since the general principles of a toner for forming secure images on a document and methods of forming and using the system have been defined herein.

Figure 1:
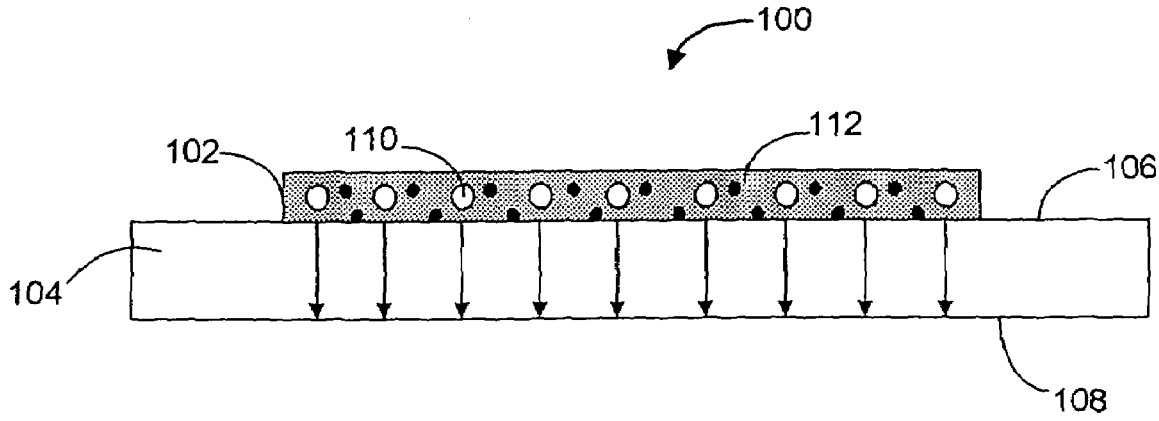

FIG. 1 illustrates a system 100 for printing secure documents using the toner of the present invention. System 100 includes a toner 102 and a substrate 104, which work together to produce a printed image on a first surface 106 of substrate 104 and a latent copy of the image, underlying the printed image, which is visible from the first (106) and/or second surface (108) of the substrate. Documents formed using system 100 are difficult to forge and copies of documents are easily detected, because any mismatch between the printed image and the latent image indicates forgery and a missing latent image is indicative of a copy of the document.

An image is printed onto a substrate using system 100 by transferring toner 102 onto substrate 104 using, for example, an electrostatic or electrophotographic process. In this case, the toner is transferred to a portion of the substrate to create a desired image and the image is fused to the substrate using, for example, heat and/or vapor solvent processing. A latent image of the printed image is formed as a result capillary or chromatographic migration of the dye to an area underlying the printed surface of the document.

Figure 2A:
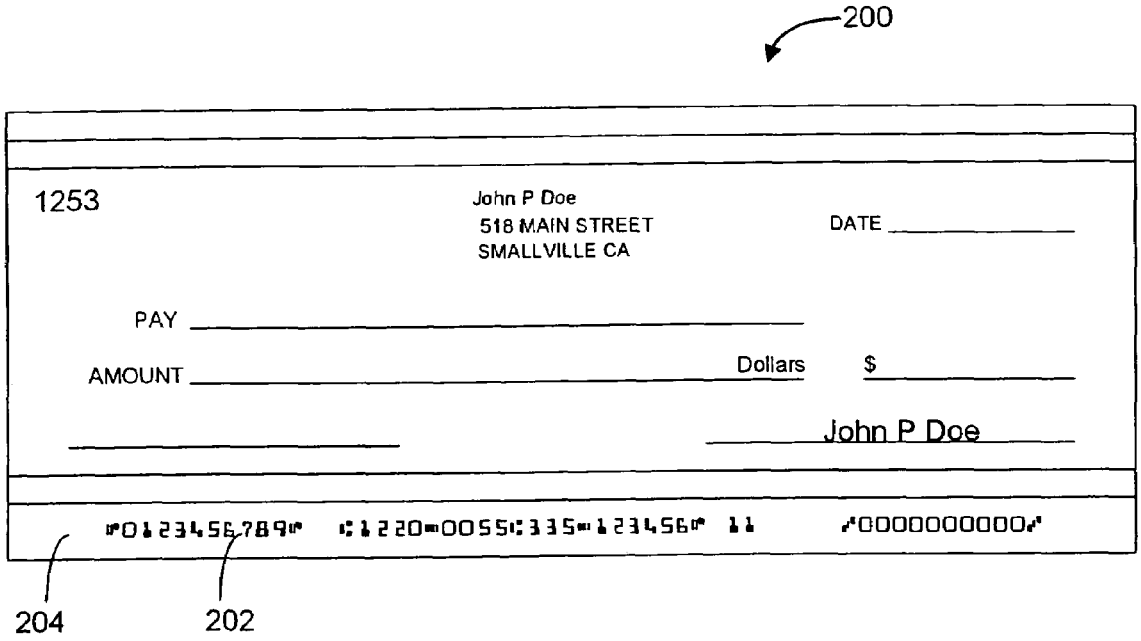
Figure 2B:
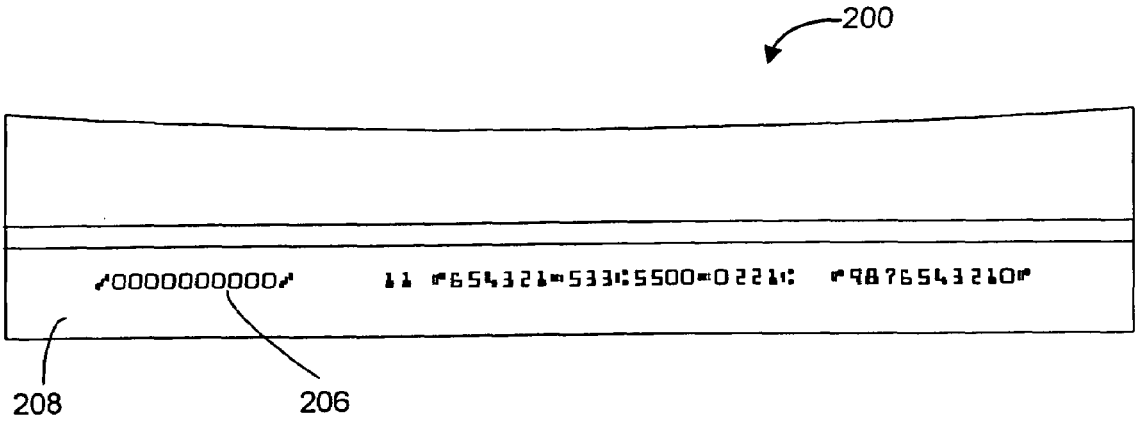

FIG. 2(*a*) and FIG. 2(*b*) illustrate a check 200 formed using system 100. In particular, FIG. 2(*a*) illustrates an image 202 printed on a first surface 204 of the check and an image 206, which forms as a result of the migrating dye, formed on or visible from an opposite surface 208 of the check.

Referring again to FIG. 1, in accordance with one embodiment of the invention, toner 102 includes a thermoplastic binder resin, a colorant, a charge-controlling agent, and a migrating dye 110. Each of the thermoplastic binder resin, the colorant, and the charge-controlling agent may be the same as those used in typical toners. Toner 102 may also include additional ingredients such as a migrating agent 112. Migrating agent 112 may be configured to assist dye 110 to migrate through the substrate and/or help fuse the dye in place after an initial migration of the dye—to, e.g., mitigate lateral spread of the dye. For illustration purposes, only the dye and the migrating agent are separately illustrated in FIG. 1. Although the illustrated toner is a one-component toner, multiple-component toner compositions (e.g., toner and developer) may also be used to form secure documents as described herein.

The thermoplastic binder resin helps fuse the toner to the substrate. In accordance with one embodiment of the invention, the binder resin has a melt index of between about 1 g/10 min. and 50 g/10 min. at 125° C. and has a glass transition temperature between about 50° C. and about 65° C. Exemplary materials suitable for the thermoplastic binder resin include polyester resins, styrene copolymers and/or homopolymers—e.g., styrene acrylates, methacrylates, styrene-butadiene—epoxy resins, latex-based resins, and the like. By way of particular example, the thermoplastic binder resin is a styrene butadiene copolymer sold by Eliokem as Pliolite S5A resin.

The colorant for use with toner 102 can be any colorant used for electrophotographic image processing, such as iron oxide, other magnetite materials, carbon black, manganese dioxide, copper oxide, and aniline black. In accordance with one particular example, the colorant is iron oxide sold by Rockwood Pigments as Mapico Black.

The charge-control agent helps maintain a desired charge within the toner to facilitate transfer of the image from, for example, an electrostatic drum, to the substrate. In accordance with one embodiment of the invention, the charge control agent includes negatively-charged control compounds that are metal-loaded or metal free complex salts, such as copper phthalocyanine pigments, aluminum complex salts, quaternary fluoro-ammonium salts, chromium complex salt type axo dyes, chromic complex salt, and calix arene compounds.

As noted above, the toner may also include a releasing agent such as a wax. The releasing agent may include low molecular weight polyolefins or derivatives thereof, such as polypropylene wax or polyethylene wax or a copolymer of polypropylene wax and polyethylene wax.

Preferred dyes in accordance with the present invention exhibit a strong color absorbance through substrate 104, good solubility in a migration fluid, good stability, and dissolve and/or migrate in polar and/or non-polar solvents used to attempt document forgery—e.g., by attempting to remove an image from the top surface of the substrate. Exemplary polar solvents used in such attempted forgery include acetone, methanol, methyl ethyl ketone, and ethyl acetate; exemplary non-polar solvents include toluene, mineral spirits, gasoline, chloroform, heptane, and diethyl ether. Furthermore, ambient heat, light, and moisture conditions, preferably do not detrimentally affect the development properties of the toner, which is desirably non-toxic. In addition, the dyes are preferably indelible. Exemplary soluble dyes for toner 102 include phenazine, stilbene, nitroso, triarylmethane, diarlymethane, cyanine, perylene, tartrazine, xanthene, azo, disazo, triphenylmethane, fluorane, anthraquinone, pyrazolone quinoline, and phthalocyanine. In accordance with one embodiment of the invention, the dye is red in color and is formed of xanthene, sold under the name Baso Red 546. In accordance with another embodiment of the invention, the dye is red in color and is formed of disazo, and sold under the name Bright Red LX-5988. In accordance with yet another embodiment of the invention, the dye is blue in color and is formed of anthraquinone, sold under the name Bright Blue LX-9224. Other color dyes of similar chemical structure are also suitable for use with this invention.

In accordance with additional embodiments of the invention, the latent image is formed using a color-forming dye such as triphenylmethane or fluorane, and a corresponding co-reactant is contained in either the toner or the substrate. The co-reactant, such as an acidic or electron-accepting compound, reacts with the color-forming dye to produce a latent image of the printed image. Exemplary co-reactant materials include bisphenol A or p-hydroxybenzoic acid butyl ester, which can also function as charge-controlling agents. The color-forming dyes are typically positively charged and thus are used in positively-charged toners. In accordance with alternative embodiments of the invention, described in more detail below, either the color-forming dye or the co-reactant may be on or within the substrate and configured to react with each other, e.g., during a fusing process, to form the security image.

When the toner includes a migration-enhancing agent, the agent may be directly incorporated with the other toner components, or mixed with the dye and then mixed with the other toner components, or adsorbed onto silica or similar compounds and then added to the other toner components, or encapsulated in a material that melts during the fusing process, or encapsulated with the dye.

An exemplary toner is formed by initially melt-blending the binder resin particles. The colorant, charge controlling agent(s), release agent(s), dye(s), and the optional migration agent(s) are admixed to the binder resin particles by mechanical attrition. The mixture is then cooled and then micronized by air attrition. The micronized particles that are between about 0.1 and 15 microns in size are classified to remove fine particles, leaving a finished mixture having particles of a size ranging from about 6 to about 15 microns. The classified toner is then dry blended with finely divided particles of inorganic materials such as silica and titania. The inorganic materials are added to the surface of the toner for the primary purpose of improving the flow of the toner particles, improving blade cleaning of the photoresponsive imaging surface, increasing the toner blocking temperature, and assisting in the charging of the toner particles. Alternatively, the security toner can be made by other types of mixing techniques not described herein in detail. Such alternative methods include melt dispersion, dispersion polymerization, suspension polymerization, and spray drying.

The following non-limiting examples illustrate various combinations of materials and processes useful in forming a toner in accordance with various embodiments of the invention. These examples are merely illustrative, and it is not intended that the invention be limited to these illustrative examples.

EXAMPLE I

The following example illustrates a preparation of an 8-micron security toner for the use in electrophotographic printing. A toner composition containing the specific composition tabulated below is initially thoroughly pre-mixed and then melt mixed in a roll mill. The resulting polymer mix is cooled and then pulverized by a Bantam pre-grinder (by Hosokawa Micron Powder System). The larger ground particles are converted to toner by air attrition and classified to a particle size with a median volume (measured on a Coulter Multisizer) of approximately 8 microns. The surface of the toner is then treated with about 0.5% dimethyldichlorosilane treated silica (commercially available through Nippon Aerosil Co. as Aerosil R976) by dry mixing in a Henschel mixer.

| Component | Chemical | Manufacturer | Exemplary Compositions (weight parts) | Specific Composition (weight parts) |
|---|---|---|---|---|
| Thermoplastic Binder Resin | Linear Polyester | Image Polymers-XPE-1965 | 20-50 | 46 |
| Charge-Controlling Agent | Aniline | Orient Chemical Company-Bontron NO1 | 0–3 | 1 |
| Colorant | Iron Oxide | Rockwood Pigments Mapico Black | 10–50 | 42 |
| Releasing Agent | Polypropylene | Sanyo Chemical Industries-Viscol 330P | 0–15 | 5 |
| Dye | Azo organic Dye | Keystone Aniline Corp. Keyplast Red | 1–20 | 6 |

This prepared mono-component toner is loaded into the proper cartridge for the intended printer such as the Hewlett Packard 5Si printer. An image formed using this toner exhibits a density measuring greater than 1.40 with a MacBeth Densitometer, sharp characters, and initially no migration of the red visible dye is noticed with standard Hammermill 20 pound laser copy paper.

EXAMPLE II

The following example illustrates a preparation of an 8-micron security toner including a migration agent for use in electrophotographic printing.

| Component | Chemical | Manufacturer | Exemplary Composi-tions (weight parts) | Specific Composi-tion (weight parts) |
|---|---|---|---|---|
| Thermoplastic Binder Resin | Linear Polyester | Image Polymers-XPE-1965 | 20-50 | 41 |
| Charge-Controlling Agent | Aniline | Orient Chemical Company-Bontron NO1 | 0–3 | 1 |
| Colorant | Iron Oxide | Rockwood Pigments Mapico Black | 10–50 | 42 |
| Releasing Agent | Polypropylene | Sanyo Chemical Industries-Viscol 330P | 0–15 | 5 |
| Dye | Azo organic Dye | Keystone Aniline Corp. Keyplast Red | 1–20 | 6 |
| Oil | Magiesol MSO Oil | | 1–10 | 4 |

The toner composition of Example II is formed in same way as the toner of Example I, except a migration agent is added to the formula. The prepared mono component toner was again tested using a mono component printer such as a Hewlett Packard 5Si. The resulting image contained adequate density, adequate resolution, no noticeable background, and initially no migration of the visible red dye. The addition of migration agent caused the chromatographic process of the red visible dye/migration agent to become faster, causing a decrease in the amount of time it took for the bleed through to the back of the substrate. Also, the migration agent enhanced the bleed through process by creating a more intense red bleed through character that had better definition. Once again, the toner on the printed side of the paper was removed and a red residual image remained. Total destruction of the document was necessary to remove the red dye.

EXAMPLE III

The following example illustrates a preparation of a 10-micron security Magnetic Ink Character Recognition (MICR) toner, including the specific weight composition tabulated below, for use in electrophotographic printing. A toner composition containing the specific composition is initially thoroughly mixed and then melt mixed in a roll mill. The resulting polymer mix is cooled and then pulverized by a Bantam pre-grinder. The larger ground particles are converted to toner by air attrition and classified to a particle size with a median volume (measured on a Coulter Multisizer) of approximately 10-microns. The surface of the toner is then treated with about 1.0% Hexamethyldisilazane treated silica (commercially available through Nippon Aerosil Co. as Aerosil R8200) by dry mixing in a Henschel mixer.

| Component | Chemical | Manufacturer | Exemplary Composi-tions (weight parts) | Specific Composi-tion (weight parts) |
|---|---|---|---|---|
| Thermoplastic Binder Resin | Linear Polyester | Image Polymers-XPE-1965 | 20-50 | 46 |
| Charge-Controlling Agent | Aniline | Orient Chemical Company-Bontron NO1 | 0–3 | 1 |
| Colorant | Iron Oxide | ISK Magnetics-MO4232 | 1–30 | 10 |
| Colorant | Iron Oxide | Rockwood Pigments-Mapico Black | 10–50 | 32 |
| Releasing Agent | Polypropylene | Sanyo Chemical Industries-Viscol 330P | 0–15 | 5 |
| Dye | Azo organic Dye | Keystone Aniline Corp. Keyplast Red | 1–20 | 6 |

This prepared mono-component toner is loaded into the proper cartridge for the intended printer such as the Hewlett Packard 5Si printer. The resulting image contains a density measuring over 1.40 on the MacBeth Densitometer, high resolution, no noticeable background, and, after initial printing, no migration of the visible red dye with standard Hammermill 20 pound laser copy paper.

For MICR evaluation, the magnetically encoded documents use a E13-B font, which is the standard font as defined by the American National Standards Institute (ANSI) for check encoding. The magnetic signals from a printed document, using the toner described above, were tested using a RDM Golden Qualifier MICR reader. The ANSI standard for MICR documents using the E13-B font requires between 50 and 200 percent nominal magnetic strength. The MICR toner, formed using the formulation provided above, exhibits a MICR signal that has a value of about 100 percent nominal magnetic strength when printing fully encoded documents.

EXAMPLE IV

The following example illustrates a 10-micron security toner, including a dye and a migration fluid in accordance with another embodiment of the invention.

| Component | Chemical | Manufacturer | Exemplary Composi-tions (weight parts) | Specific Composi-tion (weight parts) |
|---|---|---|---|---|
| Thermoplastic Binder Resin | Linear Polyester | Image Polymers-XPE-1965 | 20-50 | 41 |
| Charge-Controlling Agent | Aniline | Orient Chemical Company-Bontron NO1 | 0–3 | 1 |
| Colorant | Iron Oxide | ISK Magnetics- | 1–30 | 10 |

-continued

| Component | Chemical | Manufacturer | Exemplary Composi-tions (weight parts) | Specific Composi-tion (weight parts) |
|---|---|---|---|---|
| Colorant | Iron Oxide | MO4232 Rockwood Pigments-Mapico Black | 10–50 | 32 |
| Releasing Agent | Polypropylene | Sanyo Chemical Industries-Viscol 330P | 0–15 | 5 |
| Dye | Azo organic Dye | Keystone Aniline Corp. Keyplast Red | 1–20 | 6 |
| Oil | Magiesol MSO oil | | 1–10 | 5 |

The toner composition of Example IV is formed in same way as the toner of Example III, except a migration agent is added to the formula. The prepared mono-component toner was loaded into a cartridge for printing using a suitable printer such as a Hewlett Packard 5Si printer. The resulting image contained adequate density, measuring over 1.40 on a MacBeth Densitometer, exhibited adequate resolution, showed no noticeable background, and initially, no migration of the visible dye. The toner of this example exhibited a MICR signal of 100 percent nominal.

After it was determined that the MICR signal was acceptable, the indelible security feature was examined. Once again, the migration agent caused the chromatographic process of the red visible dye/migration agent to become faster, causing a decrease in the amount of time it took for the bleed through to the back, non-printed side of the document. Also, the migration agent enhanced the bleed through process by creating a more intense red bleed through character that had better definition. Once again, the toner on the printed side of the paper was removed and a red residual image remained. Total destruction of the document was necessary to remove the red dye.

EXAMPLE V

The following example illustrates a preparation of a 9-micron security toner for the use in electrophotographic printing. A toner composition containing the specific composition tabulated below is initially thoroughly pre-mixed and then melt mixed in a roll mill. The resulting polymer mix is cooled and then pulverized by a Bantam pre-grinder (by Hosokawa Micron Powder System). The larger ground particles are converted to toner by air attrition and classified to a particle size with a median volume (measured on a Coulter Multisizer) of approximately 9 microns. The surface of the toner is then treated with about 0.75% dimethyldichlorosilane treated silica (commercially available through Nippon Aerosil Co. as Aerosil R976) by dry mixing in a Henschel mixer.

| Component | Chemical | Manufacturer | Exemplary Composi-tions (weight parts) | Specific Composi-tion (weight parts) |
|---|---|---|---|---|
| Thermoplastic Binder Resin | Linear Polyester | Image Polymers-XPE-1965 | 20-50 | 48 |
| Charge-Controlling Agent | Aniline | Orient Chemical Company-Bontron NO1 | 0–3 | 2 |
| Colorant | Iron Oxide | ISK Magnetics-MO4232 | 10–50 | 14 |
| Colorant | Iron Oxide | Rockwood Pigments-Mapico Black | 10–50 | 28 |
| Releasing Agent | Wax | Mitsui NP-105 Co-polymer | 0–15 | 6 |
| Dye | Disazo Dye | Pylakrome Bright Red LX-5988 | 1–20 | 2 |

This prepared mono-component toner is loaded into the proper cartridge for the intended printer such as the Hewlett Packard 5Si printer. An image formed using this toner exhibits a density measuring greater than 1.30 with a MacBeth Densitometer, sharp characters, and initially no migration of the red visible dye is noticed with standard Hammermill 20 pound laser copy paper. A chemical solvent such as methyl ethyl ketone is used to remove the printed toner from the document. As the methyl ethyl ketone destroys the toner, a red stain begins to migrate within the substrate. This migration of the dye that was contained in the toner is a visual sign of document alteration.

EXAMPLE VI

A toner including a co-reactant for use with a substrate including a dye is formed as follows. A negatively charged charge-control agent including a zinc complex of salicylic acid and about 1% of Magee MSO oil are combined. The zinc complex functions as a suitable co-reactant for Copikem Red dye.

The toner of the present invention may be used in connection with any suitable substrate. For example, the toner may be used with pulp-based paper substrates, without additional coatings or embedded materials, to form secure images. By way of one particular example, as noted above, Hammermill 20 pound laser copy paper can be used to form security images with the toner of the present invention.

Figure 3:
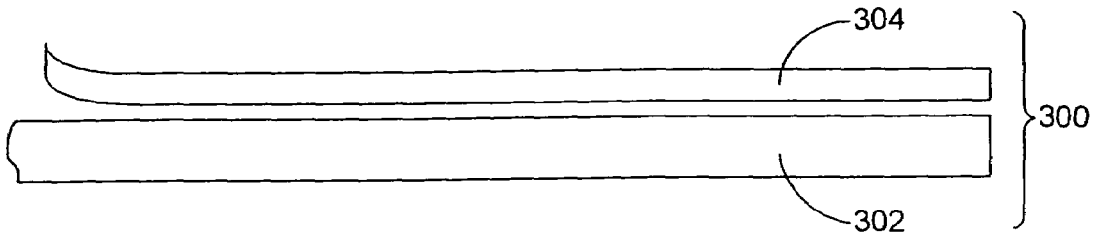
FIG. 3 illustrates a substrate suitable for use with the toner of the present invention.
Figure 4:
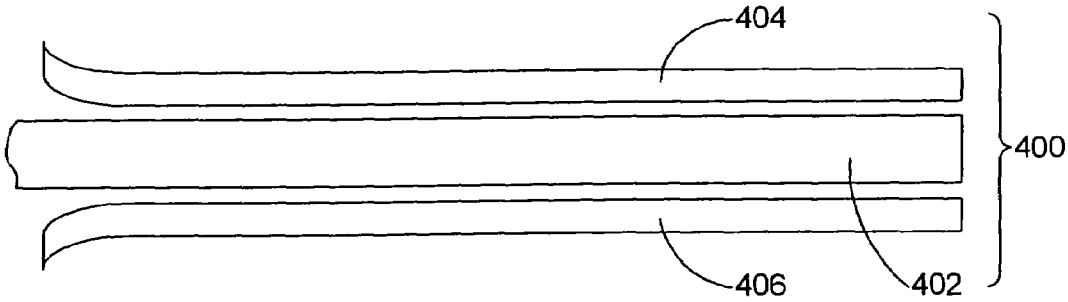
FIG. 4 illustrates another substrate suitable for use with the toner of the present invention.
Figure 5:
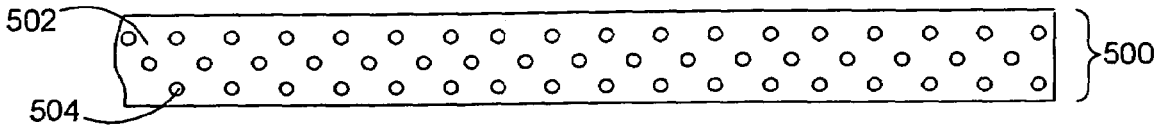
FIG. 5 illustrates yet another substrate suitable for use with the toner of the present invention.

FIGS. 3–5 illustrate various substrates, including coatings or embedded materials, which are also suitable for printing secure documents using the toner of the present invention. More particularly, FIG. 3 illustrates a substrate 300, including a base 302 and a coating 304 that includes a migration agent; FIG. 4 illustrates a substrate 400, including a base 402 and coatings 404 and 406, which include a migration agent; and FIG. 5 illustrates a substrate 500, which includes a migration agent 504 embedded or mixed in a base 502. Additional information on substrates and methods of forming the substrates is provided in application Ser. No. 10/437,751, filed May 14, 2003, by the assignee hereof, the contents of which are hereby incorporated herein by reference.

Materials suitable for bases 302, 402, and 502 include paper such as pulp-based paper products. When the substrate is formed of pulp-based paper, the paper pulp fibers may be produced in mechanical, chemical-mechanical, or a chemical manner. Pulp can be manufactured from, for example, a lignocellulosic material, such as softwood or hardwood, or can be a mixture of different pulp fibers, and the pulp may be unbleached, semi-bleached, or fully bleached. In addition to the pulp fibers, a paper base may contain one or more components typically used in paper manufacturing, such as starch compounds, hydrophobizing agents, retention agents, shading pigments, fillers, and triacetin.

The migration fluid can be any chemical or compound that acts as a solvent for the dye (e.g., dye 110) and that can be contained within or on the base without significantly detrimentally affecting the characteristics of the base. Exemplary migration agents suitable for coating 304, 404, 406 and for migration agent 504 include oils, plasticizers, liquid polymers, or any combination of these components—e.g., one or more of: plasticizers such as 2,2,4 trimethyl-1,3 pentanediol diisobutyrate, triacetin, bis (2-ethylhexyl adipate), ditridecyl adipate, adipate ester, or phthalate ester; aromatic and aliphatic hydrocarbons such as: carboxylic acids, long chain alcohols, or the esters of carboxylic acids and long chain alcohols; and liquid polymers such as: emulsion of polyvinyl alcohols, polyesters, polyethylenes, polypropylenes, polyacrylamides, and starches.

When the migration fluid is coated onto the substrate, as illustrated in FIGS. 3 and 4, any known coating technique such as rod, gravure, reverse roll, immersion, curtain, slot die, gap, air knife, rotary, spray coating, or the like may be used to form a coating (e.g., coating 304) overlying a base (e.g., base 302). The specific coating technique may be selected as desired and preferably provides a migration-enhancing-agent coating that is substantially uniformly distributed across a substrate such as a traveling web of paper.

A desired amount of the coating containing the migration fluid may vary from application to application. By way of particular example, a substrate includes one coating applied to a surface and the amount of coating is about 0.1 $g/m^2$ to about 20 $g/m^2$, and preferably about 6 $g/m^2$ to about 8 $g/m^2$. Alternatively, where the substrate includes two coatings, as illustrated in FIG. 4, it may be desirable to have different migration-enhancing coatings on each surface of the substrate. In this case, the coating on the back surface is about 0.1 $g/m^2$ to about 20 $g/m^2$, and preferably about 4 $g/m^2$ to about 5 $g/m^2$, and the coating of the front of the substrate is about 0.1 $g/m^2$ to about 5 $g/m^2$, and preferably about 2 $g/m^2$ to about 3 $g/m^2$. A desired amount or thickness of the coating is determined by factors such as the base paper thickness, porosity of the paper, any paper pre-treatment, and a desired intensity and clarity of an image formed with the die on the back surface of the substrate. For example, if more dye migration is desired, an amount of coating and/or migration-enhancing agent can be increased, and if less dye migration is desired, an amount of coating and/or migration-enhancing agent can be decreased.

The coating that is applied to paper substrate may contain only the migration-enhancing agent. Alternatively, additional chemicals can be added to the coating to, for example, seal the migration fluid, facilitate separation of multiple substrates from one another, and the like. The additional coating components may be applied with the migration-enhancing agent or in a separate deposition step (before or after application of the migration-enhancing agent to the base). For example, the migration fluid can be sealed within the base paper with a wax material such as Kemamide E wax. Alternatively, the coating may include a polymer such as polyvinyl alcohol or polyethylene glycol, to provide a barrier from one sheet of paper to the next. The migration fluid, whether coated onto the substrate or embedded within the base, can also be encapsulated within a suitable polymer shell that ruptures during the printer fusing process. Alternatively, the migration-enhancing agent may be absorbed onto a carrier such as silica and coated onto the paper. In the example illustrated in FIG. 4, a first coating 404, which is on a back surface of the substrate includes a wax and suitable solvents to assist with the application of the coating material (which may evaporate after the coating is applied to the base) and the second coating includes only the migration-enhancing agent and any solvents.

In addition to or as an alternative to the migration-enhancing agent, the coating or active agent may include a co-reactant, and/or a colorless and/or dye-forming material as described above to form a security image of the printed image.

Although the present invention is set forth herein in the context of the appended drawing figures, it should be appreciated that the invention is not limited to the specific form shown. For example, while the invention is conveniently described in connection with electrostatic printing, the invention is not so limited; the toner of the present invention may be used in connection with other forms of printing—such as iongraphic, magnetographic, and similar imaging techniques Various other modifications, variations, and enhancements in the design and arrangement of the method and system set forth herein, may be made without departing from the spirit and scope of the present invention as set forth in the appended claims.

What is claimed is:

1. A chemically sensitive toner for producing a secure image on a substrate, the toner comprising:

a colorant for forming an image on a first surface of a substrate; and a visible dye for forming an indelible copy of the image on the substrate, the visible dye being configured to diffuse through a portion of the substrate upon coming into contact with a solvent to thereby indicate an attempted alteration of the image by use of the solvent.

2. The toner of claim 1, further comprising a migration-enhancing agent.

3. The toner of claim 2, wherein the migration-enhancing agent comprises a material selected from the group consisting of an oil, a plasticizer, a liquid polymer, or a combination thereof.

4. The toner of claim 1, further comprising a thermoplastic binder.

5. The toner of claim 4, wherein the thermoplastic resin component comprises a material selected from the group consisting of one or more of the following: polyester resins, styrene homopolymers or copolymers, epoxy resins, and latex-based resins.

6. The toner of claim 1, further comprising a charge-controlling agent.

7. The toner of claim 6, wherein the charge controlling agent comprises a material selected from the group consisting of copper phthalocyanine pigments, aluminum complex salts, quaternary fluoro-ammonium salts, chromium complex salt type axo dyes, chromic complex salt, and calix arene compounds.

8. The toner of claim 1, wherein the colorant comprises a material selected from the group consisting of iron oxide, magnetite materials, carbon black, manganese dioxide, copper oxide, and aniline black.

9. The toner of claim 1, wherein the visible dye comprises a material selected from the group consisting of phenazine, stilbene, nitroso, triarylmethane, diarlymethane, cyanine, perylene, tartrazine, xanthene, azo, disazo, triphenylmethane, anthraquinone, pyrazolone quinoline, and phthalocyanine.

10. The toner of claim 9, wherein the visible dye comprises xanthene.

11. The toner of claim 9, wherein the visible dye comprises a red disazo compound.

12. The toner of claim 9, wherein, the visible dye comprises a blue anthraquinone compound.

13. The toner of claim 1, wherein the visible dye is configured such that the dye migrates from a first surface of the substrate to a second surface of the substrate to form an indelible image on the second surface.

14. The toner of claim 1, wherein the solvent is a polar solvent.

15. The toner of claim 1, wherein the solvent is a non-polar solvent.

16. The toner of claim 1, wherein the colorant includes magnetic material suitable for use with magnetic ink character recognition printing techniques.

17. The toner of claim 1, further comprising a releasing agent.

18. The toner of claim 17, wherein the releasing agent comprises a material selected from the group consisting of polyolefins and derivatives of polyolefins.

19. The toner of claim 1, wherein the toner is configured for use in one of: a mono-component developer system, a two-component developer system, or a vapor fusing system.

20. A method of forming a toner, the method comprising the steps of:

melt-blending binder resin particles; and admixing a colorant and a dye to the binder resin particles to form an admixture, the dye being configured to diffuse upon coming into contact with a solvent.

21. The method of claim 20, wherein the step of admixing comprises mixing by mechanical attrition.

22. The method of claim 20, further comprising the step of micronizing the admixture by air attrition to form micronized particles.

23. The method of claim 20, further comprising the step of classifying the micronized particles.

24. The method of claim 23, wherein the step of classifying includes segregating particles having a size of about 0.1 to about 15 microns.

25. The method of claim 20, further comprising the step of dry blending the classified particles with inorganic material.

26. The method of claim 20, wherein the toner is formed using a process selected from the group consisting of: melt dispersion, dispersion polymerization, suspension polymerization, and emulsification, melt mixing, and spray drying.

27. A toner for producing a secure image on a substrate, the toner comprising:

a colorant for forming an image on a first surface of a substrate;

a visible dye configured to migrate through a portion of the substrate to form an indelible copy of the image, the visible dye to diffuse through a portion of the substrate upon contact with a solvent to thereby indicate an attempted alteration of the image; and a migration-enhancing agent.

* * * * *